US010677507B2

(12) United States Patent
Kim et al.

(10) Patent No.: US 10,677,507 B2
(45) Date of Patent: Jun. 9, 2020

(54) EVAPORATOR AND REFRIGERATOR HAVING THE SAME

(71) Applicant: LG ELECTRONICS INC., Seoul (KR)

(72) Inventors: Jeongwoong Kim, Seoul (KR); Woocheol Kang, Seoul (KR); Geunhyung Lee, Seoul (KR); Gwinan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 178 days.

(21) Appl. No.: 15/557,708

(22) PCT Filed: Aug. 1, 2016

(86) PCT No.: PCT/KR2016/008440
§ 371 (c)(1),
(2) Date: Sep. 12, 2017

(87) PCT Pub. No.: WO2017/164465
PCT Pub. Date: Sep. 28, 2017

(65) Prior Publication Data

US 2018/0106526 A1 Apr. 19, 2018

(30) Foreign Application Priority Data

Mar. 22, 2016 (KR) ..... 10-2016-0034188

(51) Int. Cl.
*F25D 21/08* (2006.01)
*F25B 39/02* (2006.01)
(Continued)

(52) U.S. Cl.
CPC ..... *F25D 21/08* (2013.01); *F25B 39/02* (2013.01); *F25B 47/02* (2013.01); *F25D 21/002* (2013.01);
(Continued)

(58) Field of Classification Search
CPC ..... F25D 21/08; F25D 11/02; F25D 23/061; F25D 21/002; F25B 2400/01; F25B 39/02; H05B 3/56
See application file for complete search history.

(56) References Cited

U.S. PATENT DOCUMENTS 2,619,811 A * 12/1952 Philipp ..... F25B 39/024 62/519
2,758,150 A * 8/1956 Rouholah ..... F25D 21/08 174/84 C
(Continued)

FOREIGN PATENT DOCUMENTS

EP 1178268 2/2002
JP 4308070 8/2009
(Continued)

OTHER PUBLICATIONS

Extended European Search Report in European Application No. 16895591.2, dated Oct. 24, 2019, 9 pages.

*Primary Examiner* — Ana M Vazquez
(74) *Attorney, Agent, or Firm* — Fish & Richardson P.C.

(57) ABSTRACT

The present disclosure relates to an evaporator, including an evaporator case formed in a box shape with both sides open in a manner of bending two case sheets coupled to each other, a cooling tube left as an empty space between the two case sheets to form a cooling passage for a flow of refrigerant, a heating tube left as an empty space between the two case sheets in a non-overlapping manner with the cooling tube, and a heating wire heater inserted into the heating tube to surround the evaporator case, and generating heat, in response to power supplied, such that heat for defrosting is transferred to the evaporator case.

15 Claims, 8 Drawing Sheets

(51) Int. Cl.

| | |
|---|---|
| ***H05B 3/56*** | (2006.01) |
| ***F25B 47/02*** | (2006.01) |
| ***F25D 21/00*** | (2006.01) |
| ***F25D 23/06*** | (2006.01) |
| *F25D 11/02* | (2006.01) |

(52) U.S. Cl.
CPC ..... *H05B 3/56* (2013.01); *F25B 2400/01* (2013.01); *F25D 11/02* (2013.01); *F25D 23/061* (2013.01)

(56) References Cited

U.S. PATENT DOCUMENTS

| | | | | | |
|---|---|---|---|---|---|
| 2,777,300 | A * | 1/1957 | Palmer | C08G 63/6856 | 165/170 |
| 3,195,320 | A * | 7/1965 | Shoichi | F25D 21/008 | 174/152 R |
| 3,452,183 | A | 6/1969 | Burger | | |
| 7,124,602 | B2 * | 10/2006 | Lee | F25D 23/061 | 62/451 |

FOREIGN PATENT DOCUMENTS

| | | | | |
|---|---|---|---|---|
| KR | 10-1997-0028312 | | 6/1997 | |
| KR | 1999-0020164 | | 6/1999 | |
| KR | 10-2000-0007369 | | 2/2000 | |
| KR | 20-0170050 | | 3/2000 | |
| KR | 10-2003-0052846 | | 6/2003 | |
| KR | 101390656 | B1 * | 5/2014 | |
| WO | WO-2011138145 | A1 * | 11/2011 | F25D 23/061 |

* cited by examiner

EVAPORATOR AND REFRIGERATOR HAVING THE SAME

CROSS-REFERENCE TO RELATED APPLICATIONS

This application is the National Stage filing under 35 U.S.C. 371 of International Application No. PCT/KR2016/008440, filed on Aug. 1, 2016, which claims the benefit of earlier filing date and right of priority to Korean Application No. 10-2016-0034188, filed on Mar. 22, 2016, the contents of which are all hereby incorporated by reference herein in their entirety.

TECHNICAL FIELD

The present disclosure relates to an evaporator having a defrosting device for removing frost implanted, and a refrigerator having the same.

BACKGROUND ART

A refrigerator is an apparatus for keeping foods stored therein in a cool and fresh state using cold air generated by a refrigerating cycle in which processes of compression-condensation-expansion-evaporation are continuously executed.

A refrigerating cycle within a refrigerating chamber includes a compressor compressing refrigerant, a condenser condensing high-temperature and high-pressure refrigerant compressed in the compressor in a manner of radiating heat, and an evaporator cooling surrounding air by a cooling operation that refrigerant introduced from the condenser absorbs latent heat while evaporated. A capillary or an expansion valve is provided between the condenser and the evaporator to increase a flow rate of the refrigerant and reduce pressure, to facilitate the evaporation of the refrigerant introduced into the evaporator.

A cooling method of the refrigerator may be divided into an indirect cooling method and a direct cooling method.

The indirect cooling method is a method of cooling an inside of a storage chamber by forcibly circulating cold air generated in the evaporator using a blowing fan. In general, the indirect cooling method is applied to a structure in which a cooling chamber with the evaporator installed therein is separated from a storage chamber storing foods.

The direct cooling method is a method of cooling an inside of the storage chamber by natural convection of the cold air generated in the evaporator. The direct cooling method is generally applied to a structure in which an evaporator is formed in a shape of an empty box so as to form the storage chamber storing food therein.

In general, the direct cooling type refrigerator employs a roll-bond type evaporator having a cooling passage, which is formed between pressure-welded two case sheets to allow the flow of refrigerant therealong in a manner of pressure-welding the two case sheets with a pattern part interposed therebetween, sending high-pressure air to the press-welded pattern part to discharge the pattern part, and expanding a portion where the pattern part has been present.

Meanwhile, due to a difference of relative humidity between a surface of the evaporator and surrounding air, moisture is condensed on the surface of the evaporator and sometimes implanted as frost. The frost implanted on the surface of the evaporator brings about lowered heat-exchange efficiency of the evaporator.

For the indirect cooling type refrigerator, a defrosting heater is installed at the evaporator for removing the frost implanted on the evaporator. The defrosting heater is driven (turned on/off) according to a preset condition to generate heat, thereby melting the frost implanted on the evaporator.

In relation to the indirect cooling type refrigerator, a structure in which a refrigerant tube and a defrosting heater are disposed at a lower portion of a heat-exchange plate inclined by a predetermined angle (refer to the following prior art document).

However, the prior art has a fundamental problem of a low cooling effect due to increased contact resistance between the refrigerant tube and the heat-exchange plate resulting from that the refrigerant tube is attached on the heat-exchange plate.

Also, the evaporator in the form of the heat-exchange plate has difficulty in ensuring a capacity of a freezing chamber of a small refrigerator, which is difficult to be designed into multiple steps. In relation to this, when the heat-exchange plate is designed into one step, cold air flows downward due to a convection current, and thus foods on the heat-exchange plate are rarely maintained in a low-temperature state, compared with foods below the heat-exchange plate, due to a lowered cooling effect. In addition, when the heat-exchange plate is installed in a multi-step form, a welded portion of the refrigerant tube increases, which is not proper for a mass production of the evaporator.

These problems can be solved by the roll-bond type evaporator. However, a structure employing a defrosting heater at the roll-bond type evaporator has not been introduced yet.

Therefore, for a direct cooling type refrigerator with the roll-bond type evaporator, in order to remove frost, a compressor is forcibly turned off and thereafter natural defrosting should inconveniently be executed for a predetermined time. The long defrosting time causes difficulty in ensuring freshness of foods.

PRIOR ART DOCUMENT

Patent Document (Patent document 1) Korean Publication Patent No. 10-2005-0043463 (May 11, 2005)

DISCLOSURE

Technical Problem

Therefore, a first aspect of the detailed description is to provide an evaporator with a novel structure, in which a heating wire heater is mounted in a case of a roll-bond type evaporator applied to a direct cooling type refrigerator.

A second aspect of the detailed description is to provide an evaporator, in which heat generated from a heating wire heater can be efficiently used for removing frost implanted on an evaporator case.

A third aspect of the detailed description is to provide a mass production method of an evaporator with a heating wire heater therein through an addition of a simple process upon fabricating a case of a roll-bond type evaporator.

Technical Solution

To achieve the first aspect of the present invention, there is provided a refrigerator, including an evaporator case formed in a box shape with both sides open in a manner of bending two case sheets coupled to each other, a cooling tube left as an empty space between the two case sheets to form a cooling passage for a flow of refrigerant, a heating tube left as an empty space between the two case sheets in a non-overlapping manner with the cooling tube, and a heating wire heater inserted into the heating tube to surround the evaporator case, and generating heat, in response to power supplied, such that heat for defrosting is transferred to the evaporator case.

The second aspect of the present invention can be achieved in a manner that the heating wire heater is mounted in the evaporator case of roll-bond type without overlapping the cooling passage. For example, the heating wire heater may be configured in a form of being disposed within the evaporator case in a manner of being inserted into the heating passage. As another example, the heating wire heater may also be configured in a form of being disposed within the evaporator case in a manner being arranged between the two case sheets before coupling the two case sheets to each other.

The third aspect of the present invention can be achieved in a manner that a method of forming the heating tube is substantially the same as a method of forming the cooling tube and those tubes are formed during the same fabricating process.

Meanwhile, the refrigerator can be constructed as follows.

The heating tube may include a first heating passage and a second heating passage disposed at both sides of the cooling tube and each opened at both ends of the evaporator case.

The first and second heating passages may extend along both sides of the two case sheets coupled to each other.

The evaporator case may include a lower surface portion, a left side surface portion and a right side surface portion extending from the lower surface portion to both sides, respectively, and a left upper surface portion and a right upper surface portion extending from the left side surface portion and the right side surface portion to face the lower surface portion. The opened end portions of each of the first and second heating passages may be arranged to face each other at a top of the evaporator case.

The heating wire heater may include a first part inserted into the first heating passage, a second part inserted into the second heating passage, and a connection part connecting the first part and the second part to each other at an outer side of the evaporator case.

The first part may surround a front portion of the evaporator case, and the second part may surround a rear portion of the evaporator case.

The evaporator may further include a heat-resistant tube surrounding the connection part and formed of a heat-resistant material.

A remaining inner space, except for the heating wire heater, within each of the first and second heating passages may be filled with a filling agent for heat transfer.

Packing members for preventing a leakage of the filling agent may be mounted to both ends of each of the first and second heating passages.

The heating wire heater may include a core part made of an insulating material, a heating wire part wound around the core part and generating heat in response to power supplied, and a coating part made of an insulating material and surrounding the heating wire part.

The heating tube may be closely adhered on an outer circumferential surface of the heating wire heater.

The heating wire heater has a shape bent at at least one part.

Also, the present invention provides a method for fabricating an evaporator, the method including arranging a first pattern part and a second pattern part between two case sheets in a non-overlapping manner, joining the two case sheets to each other, forming a cooling tube corresponding to the first pattern part and a heating tube corresponding to the second pattern part by injecting high-pressure air to the first pattern part and the second pattern part externally exposed from the joined two case sheets, inserting a heating wire heater for defrosting into the heating tube, and forming an evaporator case in a box shape with both sides open in a manner of bending the joined two case sheets.

The heating tube may include a first heating passage and a second heating passage arranged at both sides of the cooling tube, respectively. The heating wire heater may extend to an outer side of the evaporator case through the first heating passage and then be inserted through the second heating passage.

In addition, the present invention provides a method for fabricating an evaporator, the method including arranging a pattern part and a heating wire heater between two case sheets in a non-overlapping manner, joining the two case sheets to each other, forming a cooling tube corresponding to the pattern part by injecting high-pressure air to the pattern part externally exposed from the joined two case sheets, and forming an evaporator case in a box shape with both sides open by bending the joined two case sheets.

Advantageous Effects

The present invention can obtain the following effects.

First, since a cooling tube and a heating tube are formed in an evaporator case as a roll-bond type, the cooling tube is filled with refrigerant and a heating wire heater is inserted into the heating tube, a new type of evaporator with the heating wire heater disposed within the roll-bond type evaporator case applied to a direct cooling type refrigerator can be provided. Here, the heating wire heater generates heat by being driven (turned on/off) according to a preset condition and the heat generated in the heating wire heater is transferred to the evaporator case to remove frost implanted on the evaporator case in a melting manner. As such, according to the present invention, a defrosting time can be reduced more than that taken by existing natural defrosting so as to maintain freshness of foods, and cooling efficiency lowered due to the frost can increase so as to reduce power consumption.

Second, since the heating wire heater has a shaped disposed within the evaporator case, the heat generated in the heating wire heater can be used for defrosting more efficiently, compared with a structure of arranging a defrosting heater adjacent to the evaporator case at outside of the evaporator case. Also, any space required for constructing the defrosting heater is not actually needed, which may result in ensuring a capacity of a freezing chamber in maximum. In addition, when the heating wire heater surrounds each of front and rear portions of the evaporator case, defrosting can be evenly executed over an entire region of the evaporator case.

Third, fabricating methods of the cooling tube and the heating tube are substantially the same as each other and parts (formation of the heating tube, etc.) of the fabricating processes can be executed simultaneously. Therefore, a mass production of an evaporator having the heating wire heater therein can be allowed by an addition of a simple process (insertion of the heating wire heater, etc.) upon fabricating the existing roll-bond type evaporator case.

MODE FOR INVENTION

Hereinafter, description will be given in more detail of an evaporator and a refrigerator having the same with reference to the accompanying drawings.

For the sake of brief description with reference to the drawings, the same or equivalent components may be provided with the same or similar reference numbers, and description thereof will not be repeated.

Also, for even other embodiments, a structure applied to one embodiment, unless structurally and functionally contradictory, will be equally applied to another embodiments.

The expression in the singular form in this specification will cover the expression in the plural form unless otherwise indicated obviously from the context.

In describing the present invention, moreover, the detailed description will be omitted when a specific description for publicly known technologies to which the invention pertains is judged to obscure the gist of the present invention.

The accompanying drawings are used to help easily understood the technical idea of the present invention and it should be understood that the idea of the present disclosure is not limited by the accompanying drawings but cover modifications and variations of this invention provided they come within the scope of the appended claims and their equivalents.

Figure 1:
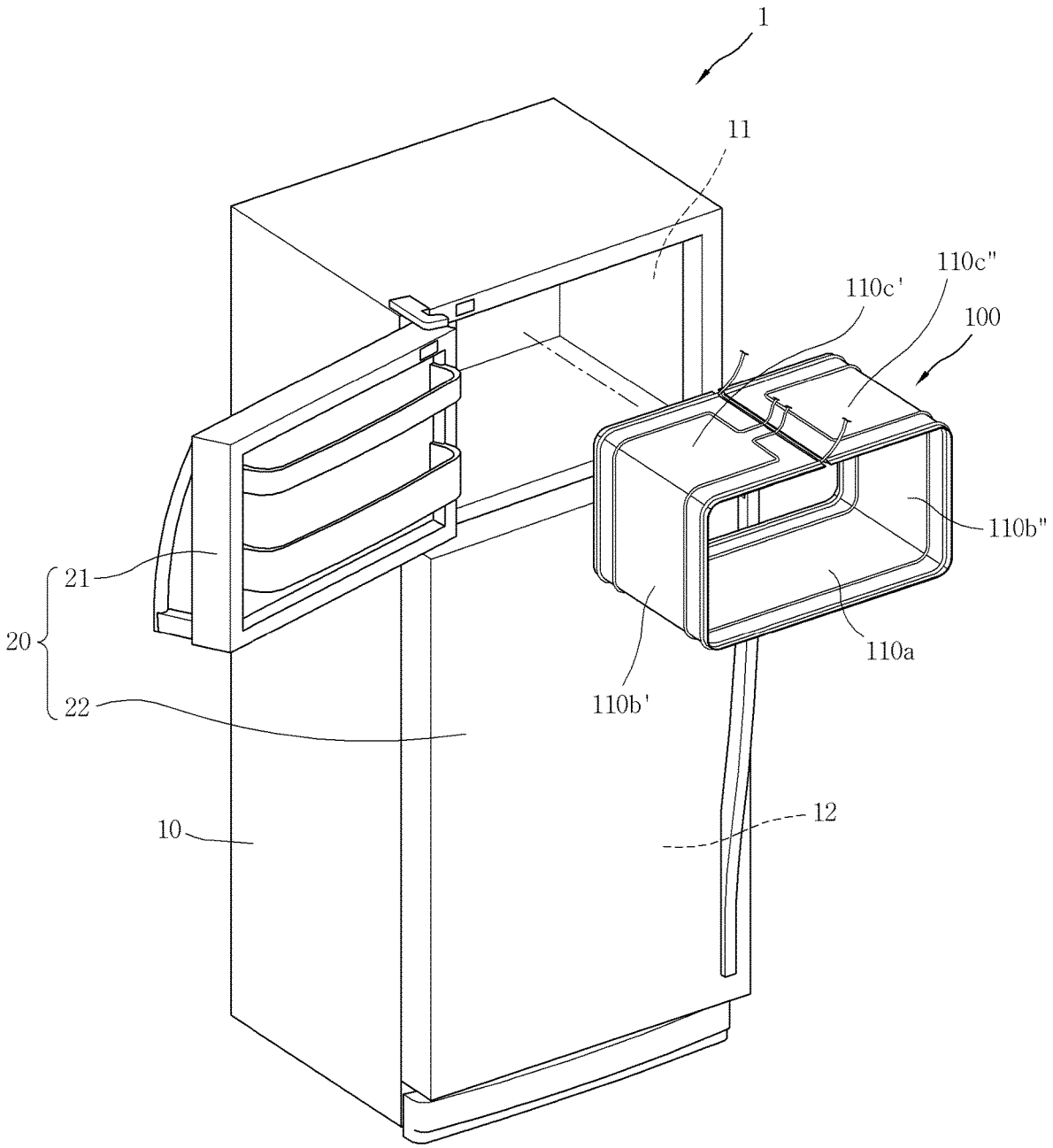
FIG. 1 is a conceptual view of a refrigerator in accordance with one embodiment of the present invention.

FIG. 1 is a conceptual view of a refrigerator 1 in accordance with one embodiment of the present invention.

The refrigerator 1 is an apparatus for keeping foods stored therein in a cool and fresh state using cold air generated by a refrigerating cycle in which processes of compression-condensation-expansion-evaporation are continuously executed.

As illustrated, a cabinet 10 is provided with a storage space for storing foods therein. The storage space may be divided by a partition wall, specifically, into a freezing chamber 11 and a refrigerating chamber 12 according to a set temperature.

This embodiment illustrates a top mount type refrigerator having the freezing chamber 11 above the refrigerating chamber 12, but the present invention may not be limited to this. This embodiment may alternatively be applied to a side by side type refrigerator having a refrigerating chamber and a freezing chamber arranged side by side, and a bottom freezer type refrigerator having a refrigerating chamber above a freezing chamber.

A door 20 is connected to the cabinet 10 to open and close a front opening of the cabinet 10. This drawing illustrates that a freezing chamber door 21 and a refrigerating chamber door 22 are configured to open and close front openings of the freezing chamber 11 and the refrigerating chamber 10, respectively. The door 20 may be implemented into various types, such as a rotatable door connected to the refrigerator main body 10 in a rotatable manner, a drawer-type door connected to the refrigerator main body 10 in a slidable manner, and the like.

The cabinet 10 is provided with a machine room (not illustrated), in which a compressor, a condenser and the like are disposed. The compressor and the condenser are connected to an evaporator 100 to construct a refrigerating cycle.

Meanwhile, a refrigerant R circulating along the refrigerating cycle absorbs surrounding heat of the evaporator 100 as evaporation heat and thus cools the surroundings of the evaporator 100. During this process, when a temperature difference from surrounding air is generated, moisture in the air is condensed and frozen, namely, frost is implanted on the surface of the evaporator 100. The frost implanted on the surface of the evaporator 100 causes lowered heat-exchange efficiency of the evaporator 100.

For an indirect cooling type refrigerator, a structure in which a defrosting heater is installed at an evaporator for removing frost implanted on the evaporator is widely known. However, as illustrated in the embodiment, for the direct cooling type refrigerator 1, any structure having the defrosting heater applied to the evaporator 100 has not been introduced yet.

Therefore, the present invention will describe a new type of evaporator 100 capable of reducing power consumption during defrosting by applying a defrosting heater to the evaporator 100 of the direct cooling type refrigerator 1.

Figure 2:
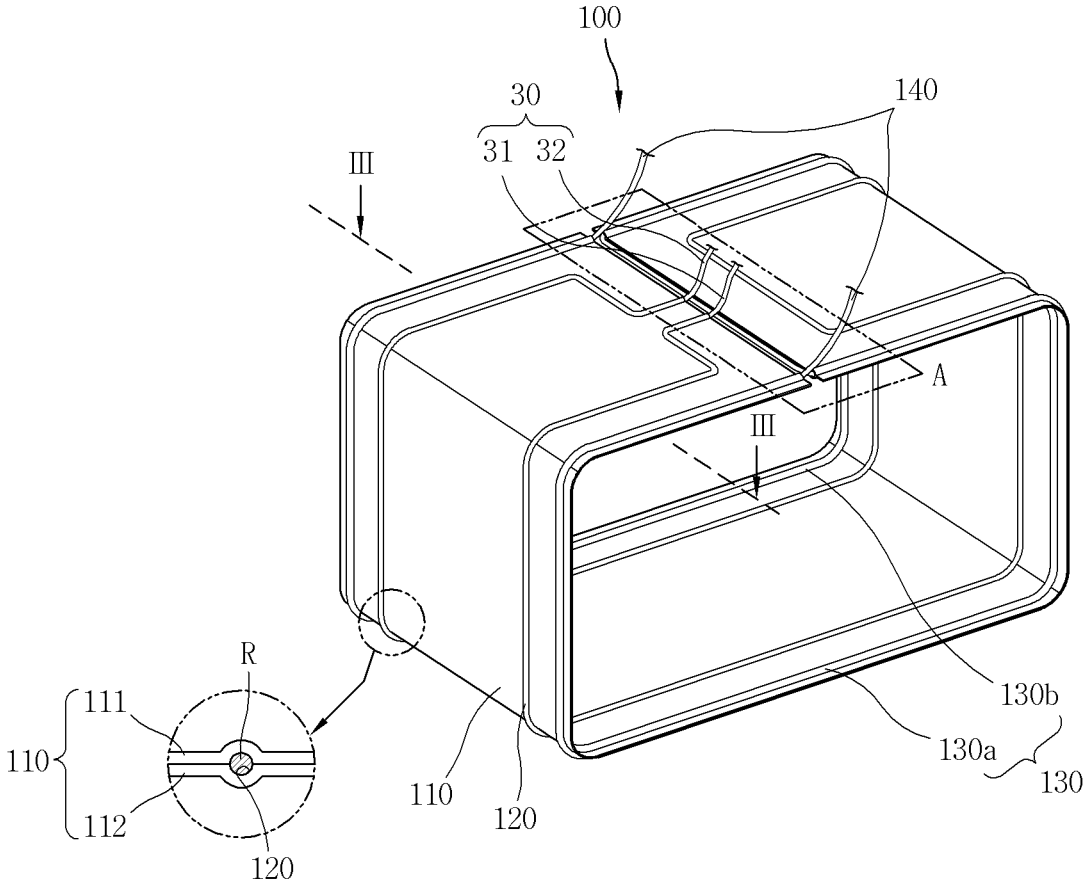
FIG. 2 is a conceptual view illustrating a first embodiment of an evaporator applied to the refrigerator of FIG. 1.
Figure 3:
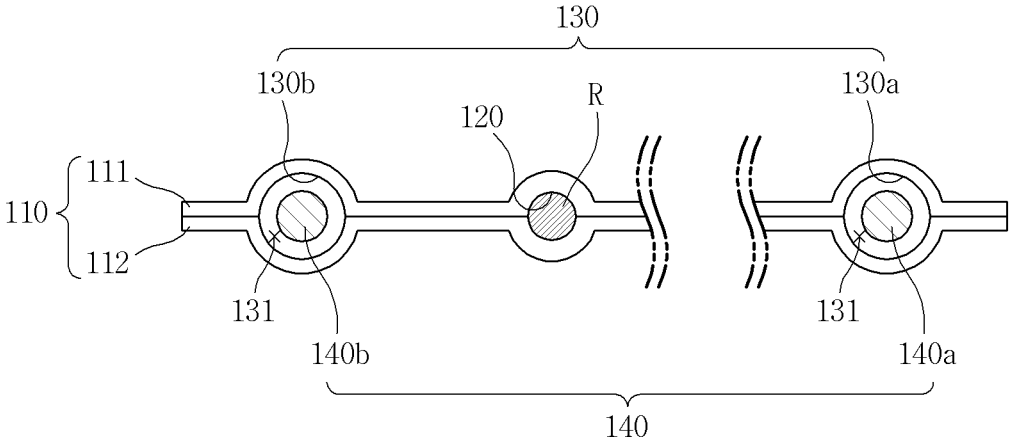
FIG. 3 is a sectional view of the evaporator illustrated in FIG. 2, taken along the line III-III.

FIG. 2 is a conceptual view illustrating a first embodiment of an evaporator 100 applied to the refrigerator 1 of FIG. 1, and FIG. 3 is a sectional view of the evaporator 100 illustrated in FIG. 2, taken along the line III-III.

As illustrated in FIGS. 2 and 3, the evaporator 100 according to the present invention includes an evaporator case 110, a cooling tube 120, a heating tube 130 and a heating wire heater 140. The cooling tube 120 of those components of the evaporator 100 corresponds to a component for cooling, and the heating tube 130 and the heating wire heater 140 correspond to components for defrosting. For reference, the cooling tube 120 and the heating tube 130 are merely illustrative for convenience of explanation, and actually those components may have various forms.

The evaporator case 110 is formed in a shape of an empty box to define a storage space of foods therein. The evaporator case 110 itself may define the storage space of foods therein, or be configured to cover a separately-provided housing (not illustrated) to define such storage space of foods.

The evaporator case 110 is provided with the cooling tube 120 along which a refrigerant R for cooling flows, and the heating tube 130 in which the heating wire heater 140 for defrosting is accommodated. The cooling tube 120 and the heating tube 130 are mounted in at least one surface of the evaporator case 110, so as to form a cooling passage for the flow of the refrigerant R, and a heating passage for accommodation of the heating wire heater 140.

The cooling tube 120 and the heating tube 130 are formed into preset patterns within the case 110, respectively. Here, the cooling tube 120 and the heating tube 130 do not overlap each other to form separate passages [cooling passage and heating passage], respectively.

This embodiment exemplarily illustrates that the heating tube 130 surrounds the cooling tube 120. That is, the cooling tube 120 is formed within the heating passage in an open-loop shape, formed by the heating tube 130.

Hereinafter, a method of fabricating the evaporator case 110 with the cooling tube 120 and the heating tube 130 will be described.

First, a first case sheet 111 and a second case sheet 112 which are materials of the evaporator case 110 are prepared. Each of the first and second case sheets 111 and 112 may be made of a metal material (e.g., aluminum, steel, etc.), and provided with a coated layer formed on a surface thereof to prevent corrosion due to a contact with moisture.

A first pattern part corresponding to the cooling tube 120 and a second pattern part corresponding to the heating tube 130 are arranged on the first case sheet 111. The first and second pattern parts are patterned into independent shapes without intersecting with each other such that the cooling tube 120 and the heating tube 130 cannot overlap each other. The first and second pattern parts are components to be removed later, and made of a graphite material arranged into preset patterns.

Each of the first and second pattern parts may be consecutively formed without a disconnection therebetween, and have at least part formed in a bent shape. Each of the first and second pattern parts may extend from a first edge to a second edge of the first case sheet 111. The first edge at which each of the first and second pattern parts is started and the second edge at which each of those pattern parts is ended may be the same edge or different edges from each other.

Next, the first and second case sheets 111 and 112 are arranged to be brought into surface-contact with each other with interposing the first and second pattern parts therebetween, and then pressed into an integral form using a roller device.

Accordingly, a plate type frame with the first and second case sheets 111 and 112 in the integral form is formed. The first and second pattern parts are located within the frame. In this state, high-pressure air is injected into the first and second pattern parts which are externally exposed through one side of the frame corresponding to the first edge.

The first and second pattern parts existing between the first and second case sheets 111 and 112 are discharged out of the frame by the injected high-pressure air. During this process, a space where the first pattern part was present is left as an empty space so as to form the cooling tube 120, and a space where the second pattern part was present is left as an empty space so as to form the heating tube 130.

During the process of discharging the pattern parts by injecting the high-pressure air, the portion where the first and second pattern parts were present are expanded relatively greater than volumes of the first and second pattern parts. Accordingly, the expanded portions of the first and second pattern parts form the cooling passage for the flow of the refrigerant R and the heating passage for the arrangement of the heating wire heater 140, respectively.

According to this fabricating method, the cooling tube 120 and the heating tube 130 are formed in a manner of which convexly protruding from at least one surface of the frame. As one example, when the first and second case sheets 111 and 112 have the same rigidity, the cooling tube 120 and the heating tube 130 protrude from both surfaces of the frame. As another example, when the rigidity of the first case sheet 111 is higher than that of the second case sheet 112, the cooling tube 120 and the heating tube 130 protrude from the second case sheet 112 with the relatively low rigidity and the first case sheet 111 with the relatively high rigidity is maintained in a flat shape.

The frame in the integrated plate form is bent and accordingly, as illustrated, the evaporator case 110 in the shape of the empty box is fabricated. As one example, additionally referring to FIG. 1, the evaporator case 110 may be formed in a shape of a rectangular box with both sides open. Namely, the evaporator case 110 in the shape of the rectangular box includes a lower surface portion 110*a*, left and right side surface portions 110*b*' and 110*b*" extending from the lower surface portion 110*a* to both sides, and left and right upper surface portions 110*c*' and 110*c*" extending from the left side surface portion 110*b*' and the right side surface portion 110*b*" to be in parallel to the low surface portion 110*a*.

The cooling tube 120 formed in the evaporator case 110 is connected to the condenser and the compressor through a cooling pipe 30, thereby constructing a refrigerating cycle. The cooling pipe 30 may be connected to the cooling tube 120 in a welding manner.

In detail, one end (inlet) of the cooling tube 120 is connected to one end 31 of the cooling pipe 30 and another end (outlet) of the cooling tube 120 is connected to another end 32 of the cooling pipe 30, to form a circulation loop of the refrigerant R. The refrigerant R in a liquid state of low temperature and low pressure is introduced through the one end of the cooling tube 120 and the refrigerant R in a gaseous state is discharged through the another end of the cooling tube 120.

With the structure, the cooling refrigerant R is filled in the cooling tube 120. As the refrigerant R circulates, the evaporator case 110 and air around the evaporator case 110 are cooled.

The evaporator 100 with the structure is formed in the shape that the roll-bond type cooling tube 120 is mounted in the evaporator case 110. Therefore, the evaporator 100 has relatively high heat-exchange efficiency, compared with a structure in which the cooling pipe 30 as a separate component surrounds the evaporator case 110. In addition, the structure of the cooling passage along which the refrigerant R flows may be simplified, which may result in more increasing the storage space for foods.

In addition, the heating wire heater 140 for defrosting is inserted into the heating tube 130 formed in the evaporator case 110, and generates heat in response to power supplied according to a preset condition. The preset condition, for example, may be a case where temperature detected by a temperature sensor (not illustrated) is lower than preset temperature, a case where humidity detected by a humidity sensor (not illustrated) is higher than preset humidity, and the like.

The heating wire heater 140 inserted in the heating tube 130 is configured to surround the evaporator case 110. In detail, the heating wire heater 140 is disposed in the heating tube 130 which is formed in each surface portion [the lower surface portion 110*c*', the side surface portions 110*b*' and 110*b*" and the upper surface portions 110*c*' and 110*e*] of the evaporator case 110.

This drawing illustrates that the heating wire heater 140 is formed to surround a front portion and a rear portion of the evaporator case 110, respectively. With the structure, heat generated in the heating wire heater 140 can evenly be transferred to an entire region of the evaporator case 110.

As described above, the present invention has the structure that the cooling tube 120 and the heating tube 130 are formed in the roll-bond type within the evaporator case 110, the cooling tube 120 is filled with the refrigerant R and the hearting wire heater 140 is inserted in the heating tube 130. Therefore, the present invention can provide such new evaporator 100 that the heating wire heater 140 is disposed in the roll-bond type evaporator case 110 applied to the direct cooling type refrigerator 1. Here, the heating wire heater 140 is driven (turned on/off) according to a preset condition to generate heat, and the heat generated in the heating wire heater is transferred to the evaporator case 110 so as to remove frost implanted on the evaporator case 110 in a melting manner. As such, according to the present invention, freshness of foods can be maintained by reducing a defrosting time, as compared with a time taken by an existing natural defrosting method, and power consumption can be reduced by virtue of an increase in cooling efficiency which has been lowered due to frost.

Also, since the heating wire heater 140 has the shape mounted in the evaporator case 110, the heat generated in the heating wire heater 140 can be more efficiently used for defrosting than the structure having a defrosting heater disposed closely at an outside of the evaporator case 110. Also, a space required for constructing the defrosting heater is not substantially needed, thereby ensuring a maximum capacity of the freezing chamber 11.

In addition, the fabricating methods of the cooling tube 120 and the heating tube 130 are substantially the same and some fabricating processes of the tubes 120 and 130 (forming the heating tube 130, etc.) may partially be executed simultaneously. This may allow a mass production of the evaporator 100 having the heating wire heater 140 therein, by way of an addition of a simple process [insertion of the heating wire heater 140, etc.] upon fabricating the existing roll-bond type evaporator case 110.

Hereinafter, the heating tube 130 and the heating wire heater 140 as the components associated with defrosting will be described in more detail.

Figure 4:
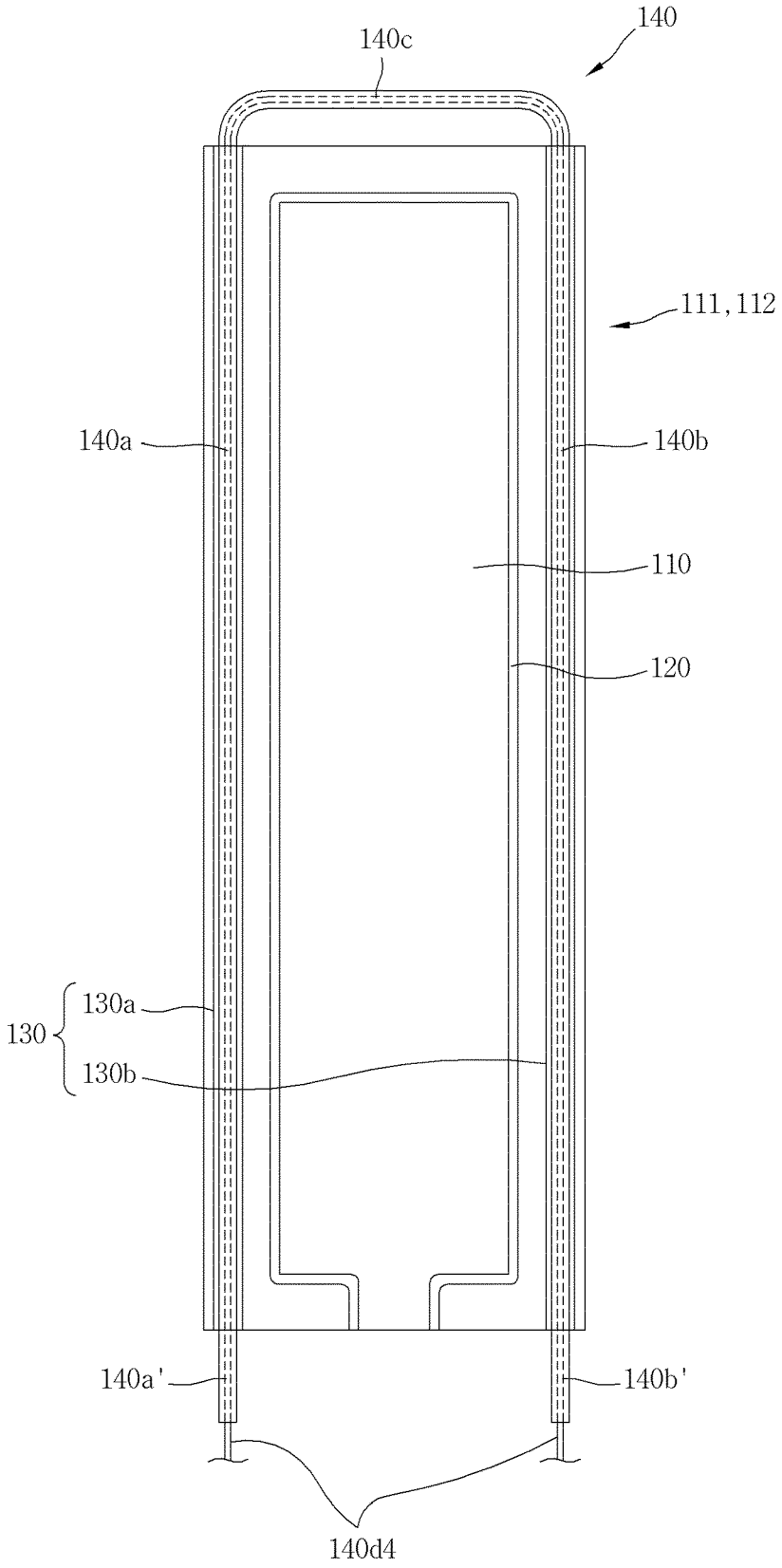
FIG. 4 is a conceptual view illustrating an unfolded state before an evaporator case illustrated in FIG. 2 is bent.

FIG. 4 is a conceptual view illustrating an unfolded state before the evaporator case 110 illustrated in FIG. 2 is bent.

Referring to FIG. 4, in the state that the cooling tube 120 and the heating tube 130 are formed in the first and second case sheets 111 and 112 coupled to each other, the heating wire heater 140 is inserted into the heating tube 130.

The heating tube 130 includes a first heating passage 130*a* and a second heating passage 130*b* disposed at both sides of the cooling tube 120. Each of the first and second heating passages 130*a* and 130*b* has a shape open at both ends of the evaporator case 110.

For the insertion of the heating wire heater 140, inner diameters of the first and second heating passages 130*a* and 130*b* are greater than an inner diameter of the heating wire heater 140. Referring back to FIG. 3, it can be noticed that an empty space 131 is left within each of the first and second heating passages 130*a* and 130*b* in the state that the heating wire heater 140 is inserted in the first and second heating passages 130*a* and 130*b*. Each empty space 131 may be filled with air or in a vacuum state. To this end, both end portions of each of the first and second heating passages 130*a* and 130*b* may be open or closed.

In addition, if the first and second heating passages 130*a* and 130*b* have a bent shape, the insertion of the heating wire heater 140 may not be allowed, or even if allowed, considerable efforts and time may be required for the insertion. Therefore, for the mass production, each of the first and second hearting passages 130*a* and 130*b* is preferably formed in a linear shape extending in one direction to facilitate the insertion of the heating wire heater 140. This drawing illustrates that the first and second heating passages 130*a* and 130*b* extend, respectively, along both sides of the first and second case sheets 111 and 112 coupled to each other.

The heating wire heater 140 may be configured to be sequentially inserted through the first and second heating passages 130*a* and 130*b*. To this end, the heating wire heater 140 may include a first part 140*a*, a second part 140*b* and a connection part 140*c*.

In detail, a portion of the heating wire heater 140 inserted into the first heating passage 130*a* constructs the first part 140*a*, a portion inserted into the second heating passage 130*b* constructs the second part 140*b*, and a portion where the first part 140*a* and the second part 140*b* are connected to each other at the outside of the evaporator case 110 constructs the connection part 140*c*. In view of an insertion order, the heating wire heater 140 includes the first part 140*a*, the second part 140*b* and the connection part 140*c*, and an extending direction of the first part 140*a* inserted in the first heating passage 130*a* is opposite to an extending direction of the second part 140*b* inserted in the second heating passage 130*b*.

When the connection part 140*c* is located at one side of the first and second case sheets 111 and 112, a first extending part 140*a*' externally extending from the first part 140*a* and a second extending part 140*b*' externally extending from the second part 140*b* are electrically connected to a power supply unit (not illustrated) at another side opposite to the one side. The heating wire heater 140 generates heat when power is applied through the power supply unit.

The foregoing description has been given of the example in which the single heating wire heater 140 is disposed within the first and second heating passages 130*a* and 130*b*, but the present invention may not be limited to this. The heating wire heater 140 may be configured as first and second heating wire heaters corresponding to the first and second heating passages 130*a* and 130*b*, respectively.

Meanwhile, the heating tube 130 extends from one end portion to another end portion of the first and second case sheets 111 and 112. Therefore, in the state that the first and second case sheets 111 and 112 are bent to form the evaporator case 110 in the box shape, the heating wire heater 140 inserted in the heating tube 130 surrounds the evaporator case 110.

For example, as illustrated, when the first and second heating passages 130*a* and 130*b* extend to both sides of the first and second case sheets 111 and 112, respectively, the first part 140*a* inserted in the first heating passage 130*a* surrounds a front portion of the evaporator case 110, and the second part 140*b* inserted in the second heating passage 130*b* surrounds a rear portion of the evaporator case 110. As such, when the heating wire heater 140 surrounds each of the front portion and the rear portion of the evaporator case 110, defrosting can be evenly executed on an entire region of the evaporator case 110.

However, the present invention may not be limited to this structure. The heating tube 130 may be formed in a central portion of the evaporator case 110, or in a front or rear portion of the evaporator case 110. Of course, according to the structure, the cooling tube 120 may be patterned in the evaporator case 110 into a deformed shape to avoid overlapping with the heating tube 130.

Figure 5:
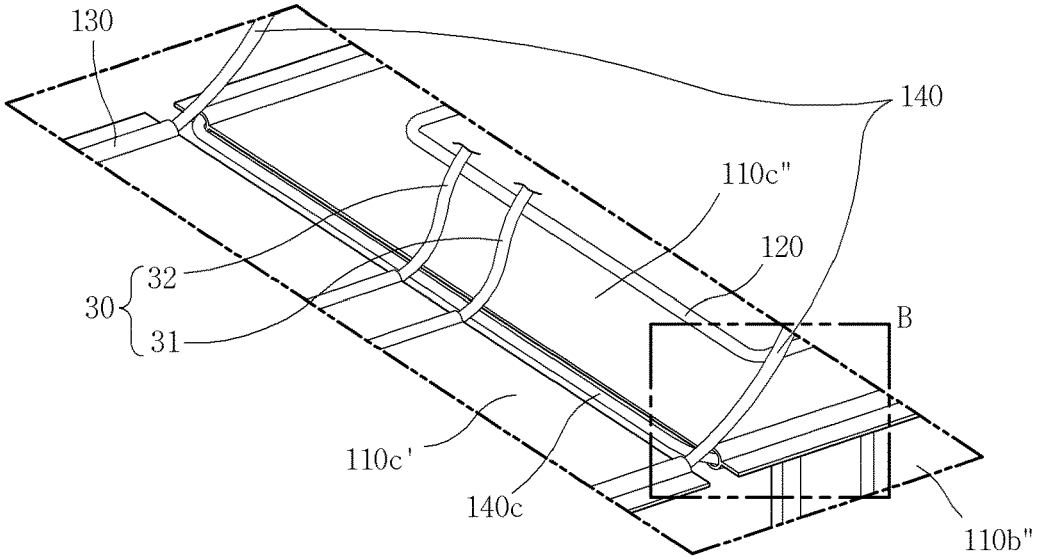
FIG. 5 is an enlarged view of a part A illustrated in FIG. 2.
Figure 6:
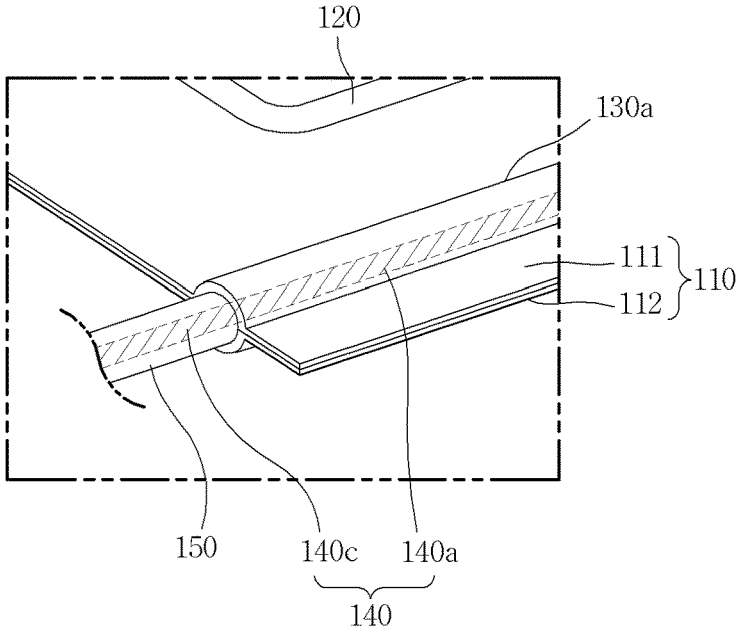
FIG. 6 is an enlarged view of a part B illustrated in FIG. 5.

FIG. 5 is an enlarged view of a part A illustrated in FIG. 2, and FIG. 6 is an enlarged view of a part B illustrated in FIG. 5.

Referring to FIGS. 5 and 6 together with the previous drawings, in the state that the heating wire heater 140 is inserted in the heating tube 130, the first and second case sheets 111 and 112 are bent to form the evaporator case 110 in the shape of a box with both sides open. As one example, the evaporator case 110 may be provided with the lower surface portion 110*a*, the left side surface portion 110*b*' and the right side surface portion 110*b*" extending from the lower surface portion 110*a* to both sides, and the left upper surface portion 110*c*' and the right upper surface portion 110*c*" extending from the left side surface portion 110*b*' and the right side surface portion 110*b*" to face the lower surface portion 110*a*.

Here, one end portion of each of the first and second heating passages 130*a* and 130*b* is open at the left upper surface portion 110*c*' of the evaporator case 110, and another end portion of each of the first and second heating passages 130*a* and 130*b* is open at the right upper surface portion 110*c*" of the evaporator case 110. As illustrated, the first extending part 140*a*' and the second extending part 140*b*' may externally extend through one end portion of the first heating passage 130*a* and one end portion of the second extending part 130*b*, respectively, and be electrically connected to the power supply unit (not illustrated). The connection portion 140*c* of the heating wire heater 140 may be located at another end portion of each of the first and second heating passages 130*a* and 130*b*.

As illustrated in FIG. 5, both open end portions of the first and second heating passages 130*a* and 130*b* may be arranged to face each other at a top of the evaporator case 110. This is configured, as aforementioned, as the first and second heating passages 130*a* and 130*b* extend in parallel along both sides of the first and second case sheets 111 and 112 to facilitate the insertion of the heating wire heater 140.

To prevent interference between portions extending through one end portion and another end portion of each of the first and second heating passages 130*a* and 130*b* of the heating wire heater 140, both open end portions of the first and second heating passages 130*a* and 130*b* may be located with being spaced apart from each other in a widthwise direction of the evaporator case 110. Here, the widthwise direction of the evaporator case 110 corresponds to a direction from the front portion to the rear portion of the evaporator case 110, or a direction that a gap between the left upper surface portion 110*c*' and the right upper surface portion 110*c*" extends.

Considering that the connecting portion 140*c* of the heating wire heater 140 is located at the another end portion of each of the first and second heating passages 130*a* and 130*b* and the connection portion 140*c* extends in the direction from the front to rear portions of the evaporator case 110 [or extending along the gap between left upper surface portion 110*c*' and the right upper surface portion 110*c*"], one end portion of the first heating passage 130*a* and one end portion of the second heating passage 130*b* may be located with being spaced apart from each other to the outside [i.e., to the adjacent front and rear portions] of the evaporator case 110, compared with the another end portions.

In this instance, in the unfolded state before the evaporator case 110 is bent as illustrated in FIG. 4, the first and second heating passages 130*a* and 130*b* may extend to be inclined with respect to both sides of the first and second case sheets 111 and 112 which are coupled to each other.

The connection part 140*c* of the heating wire heater 140 connects the first part 140*a* and the second part 140*b* at the outside of the evaporator case 110. As such, since the connection part 140*c* is exposed to the outside of the evaporator case 110, the connection part 140*c* may be likely to be damaged physically or electrically due to repetition of frosting and defrosting.

Considering this, a heat resistant tube 150 surrounds the connection part 140*c*. The heat resistant tube 150 is formed of a heat-resistant material to avoid thermal damage due to the high-temperature connection part 140*c*. With the formation of the heat-resistant tube 150, the connection part 140*c* exposed to the outside of the evaporator case 110 can be protected from an external environment, thereby enhancing defrosting reliability.

For reference, packing members (not illustrated) for preventing an introduction of defrosted water may be provided on both ends of each of the first and second heating passages 130*a* and 130*b*. The packing members may also be configured to be closely adhered on the heat-resistant tube 150 to prevent the introduction of the defrosted water into the heat-resistant tube 150. That is, the first and second heating passages 130*a* and 130*b* and the heat-resistant tube 150 may be sealed by the packing members.

Figure 7:
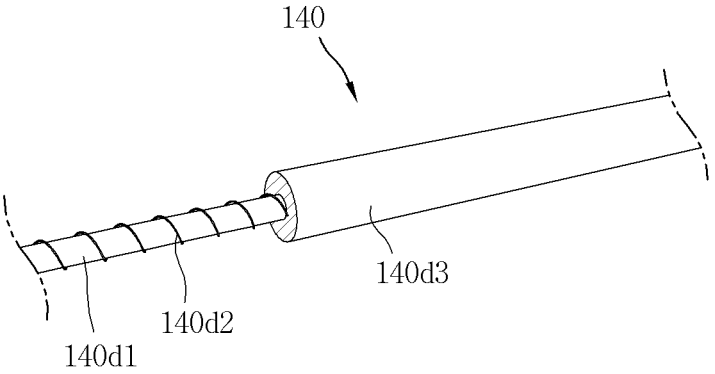
FIG. 7 is a conceptual view illustrating a detailed structure of a heating wire heater illustrated in FIG. 2.

FIG. 7 is a conceptual view illustrating a detailed structure of the heating wire heater 140 illustrated in FIG. 2, which illustrates a part of the heating wire heater 140 in a cut state.

Referring to FIG. 7, the heating wire heater 140 has heat-resistance and is flexibly bent. The heating wire heater 140 includes a core part 140*d*1, a heating wire part 140*d*2 and a coating part 140*d*3.

The core part 140*d*1 is a core on which the heating wire 132 is wound, and made of an insulating material. For example, the core part 140*d*1 may be made of glass fibers.

The heating wire part 140*d*2 is wound on an outer circumference of the core part 140*d*1, and electrically connected to the power supply unit (not illustrated) to generate heat in response to power supplied. A nickel-chrome based electric heating wire may be used as the heating wire part 140*d*2. The heating wire part 140*d*2 may extend in a lengthwise direction of the core part 140*d*1. This embodiment illustrates that the heating wire part 140*d*2 has a shape of being densely wound, like a coil, on the core part 140*d*1, to improve heat generation temperature per unit area.

The coating part 140*d*3 is made of an insulating material and surrounds the heating wire part 140*d*2. The coating part 140*d*3 may be made of a synthetic resin material [e.g., silicone rubber, PVC, etc.] having heat-resistance.

The aforementioned structure is one example of the heating wire heater 140, and the heating wire heater 140 according to the present invention may not be necessarily limited to this. Any type may be employed as the heating wire heater 140 if it has a form of a cable and generates heat upon supplying power.

Figure 8:
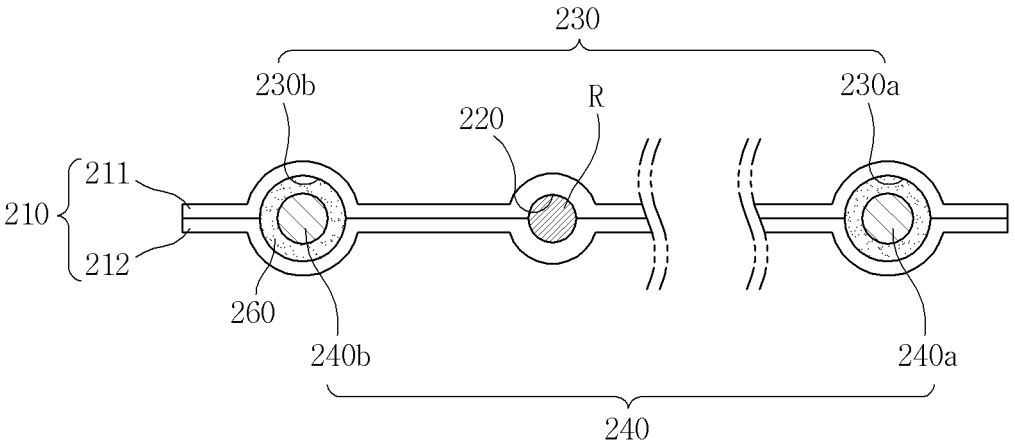
FIGS. 8 and 9 are conceptual views illustrating a second embodiment of an evaporator applied to the refrigerator of FIG. 1.
Figure 9:
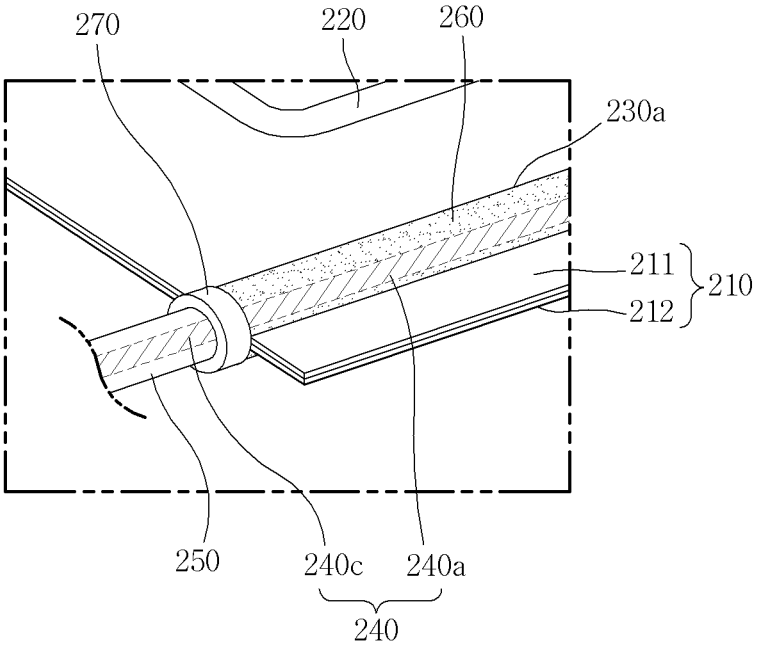

FIGS. 8 and 9 are conceptual views illustrating a second embodiment of an evaporator 200 applied to the refrigerator 1 of FIG. 1.

Similar to the first embodiment of the evaporator 100, inner diameter of each of first and second heating passages 230*a* and 230*b* are greater than an inner diameter of a heating wire heater 240 for an insertion of the heating wire heater 240. However, the first embodiment of the evaporator 100 illustrates that the remaining space within the first and second heating passages 130*a* and 130*b* after the heating wire heater 140 is inserted is left as the empty space 131, whereas this embodiment illustrates that the empty space is filled with a filling agent. In other words, a filling agent 260 for transferring heat is filled in the rest inner space except for the heating wire heater 240 within the first and second heating passages 230*a* and 230*b*.

The filling agent 260 exists in a liquid phase in a freezing condition of a refrigerator 10. Here, a refrigerant (e.g., R-134a, R-600a, etc.) serving to transfer heat through a phase change into a gaseous phase when being heated may be used as the filling agent 260.

Packing members 270 for preventing a leakage of the filling agent 260 may be mounted on both ends of each of the first and second heating passages 230*a* and 230*b*. To this end, the packing members 270 are inserted into both ends of each of the first and second heating passages 230*a* and 230*b* having at least part open, to seal the both ends.

A connection part 240*c* of the heating wire heater 240 connects a first part 240*a* and a second part 240*b* to each other at the outside of the evaporator case 210. Similar to the first embodiment of the evaporator 100, to protect the connection part 240*c*, the connection part 240*c* may be surrounded by a heat-resistant tube 250.

Here, the packing members 270 may also be configured to be closely adhered on the heat-resistant tube 250 to prevent an introduction of defrosted water into the heat-resistant tube 250. That is, the first and second heating passages 230*a* and 230*b* and the heat-resistant tube 250 may be sealed by the packing members 270.

Figure 10:
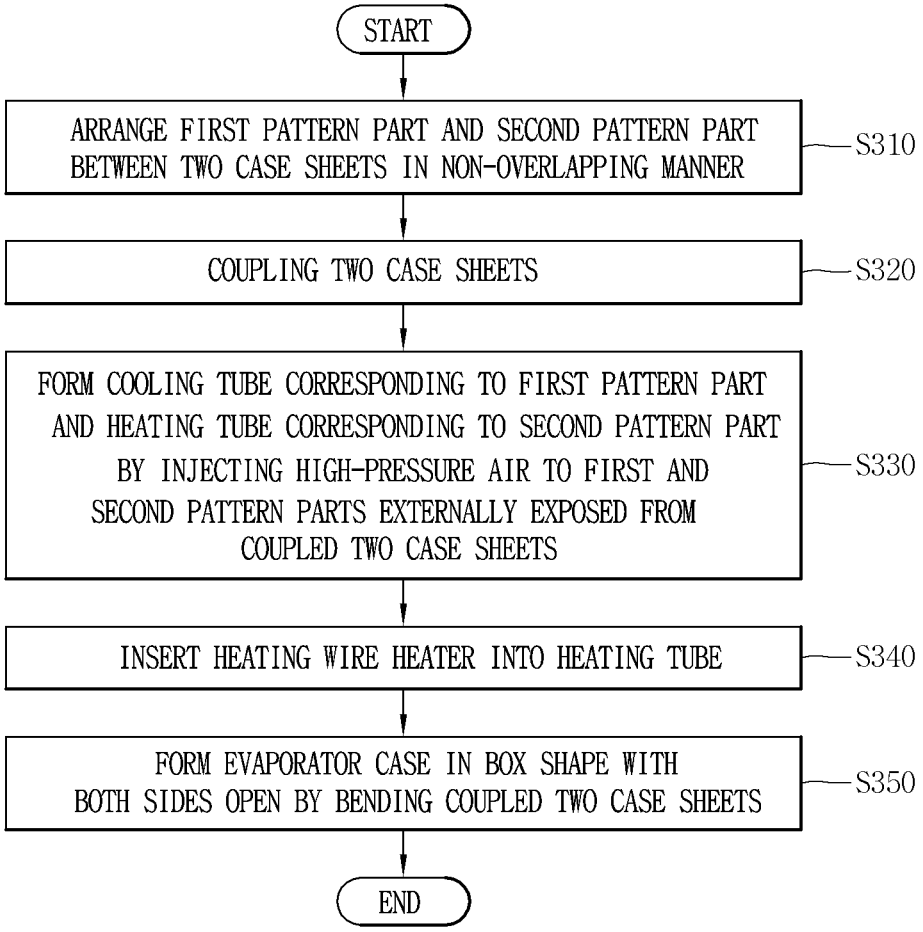
FIG. 10 is a flowchart illustrating a method of fabricating the evaporators of the first and second embodiments.

FIG. 10 is a flowchart illustrating a method of fabricating the evaporators 100 and 200 of the first and second embodiments.

Referring to FIG. 10 together with the previous drawings, the first and second embodiments are the same as each other in that the evaporator 100, 200 having the defrosting function is fabricated in the manner of inserting the heating wire heater 140, 240 in the heating tube 130, 230, but are different from each other in the aspect whether the remaining inner space of the heating tube 130, 230 except for the heating wire heater 140, 240 is left as the empty space 131 or filled with the filling agent 260 for heat transfer.

Therefore, it can be understood that the fabricating methods of the evaporators 100 and 200 according to the first and second embodiments partly include the common fabricating process.

Explaining this, first, the first pattern part and the second pattern part are disposed between the first and second case sheets 111 and 112/211 and 212 in a non-overlapping manner (S310). As aforementioned, the arranged portion of the first pattern part is the portion where the cooling tube 120, 220 is formed later, and the arranged portion of the second pattern part is the portion where the heating tube 130, 230 is formed later.

Next, the following joining (coupling) method may be used. That is, the first and second case sheets 111 and 112/211 and 212 are joined to each other (S320). As one example, the first and second case sheets 111 and 112/211 and 212 are brought into surface-contact with each other with interposing the first and second pattern parts therebetween, and then pressed into an integrated form using a roller device (hot-press joining).

Accordingly, the frame in the shape of the plate with the first and second case sheets 111 and 112/211 and 212 integrated with each other is formed, and the first and second pattern parts are located in the frame. In this state, high-pressure air is injected to the first and second pattern parts externally exposed from the joined first and second case sheets 111 and 112/211 and 212, thereby forming the cooling tube 120, 220 corresponding to the first pattern part and the heating tube 130, 230 corresponding to the second pattern part (S330).

Afterwards, the heating wire heater 140, 240 is inserted into the heating tube 130, 230 (S340). Since the frame has the plate shape and the heating tube 130, 230 extends in one direction, the heating wire heater 140, 240 can be easily inserted into the heating tube 130, 230.

As aforementioned, the heating wire heater 140, 240 may extend to the outside of the evaporator case 110, 210 through the first heating passage 130*a*, 230*a* arranged at one side of the cooling tube 120, 220, and then be inserted through the second heating passage 130*b*, 230*b* arranged at another side of the cooling tube 120, 220. Here, in the state that the heating wire heater 140, 240 has extended to the outside of the evaporator case 110, 210, the heat-resistant tubes 150, 250 may be inserted into the heating wire heater 140, 240.

Next, the frame in the plate shape with the heating wire heater 140, 240 inserted in the heating tube 130, 230 is bent to fabricate the evaporator case 110, 210 in the shape of the empty box with both sides open (S350). As the frame is bent, the heating wire heater 140, 240 inserted in the heating tube 130, 230 surrounds the evaporator case 110, 210.

Here, to fabricate the evaporator 200 according to the second embodiment, the filling agent 260 for the heat transfer is filled in the remaining inner space of the heating tube 230 except for the heating wire heater 240. The packing members 270 are mounted to both ends of the heating tube 230 after filling the filling agent 260, to prevent a leakage of the filling agent 260.

Afterwards, the cooling tube 120, 220 formed in the evaporator case 110, 210 is connected to the cooling pipe 30, such that the refrigerant R circulates along the cooling tube 120, 220. By virtue of the connection, the evaporator 100, 200 is connected to the condenser and the compressor so as to construct the refrigerating cycle.

As such, these embodiments use substantially the same fabricating method of the cooling tube 120, 220 and the heating tube 130, 230, and parts [forming the heating tube 130, 230, etc.] of the fabricating processes of the tubes can be executed simultaneously. This may allow the mass production of the evaporator 100, 200 having the heating wire heater 140, 240 therein, by way of an addition of a simple process [insertion of the heating wire heater 140, 240, etc.] upon fabricating the existing roll-bond type evaporator case 110.

Figure 11:
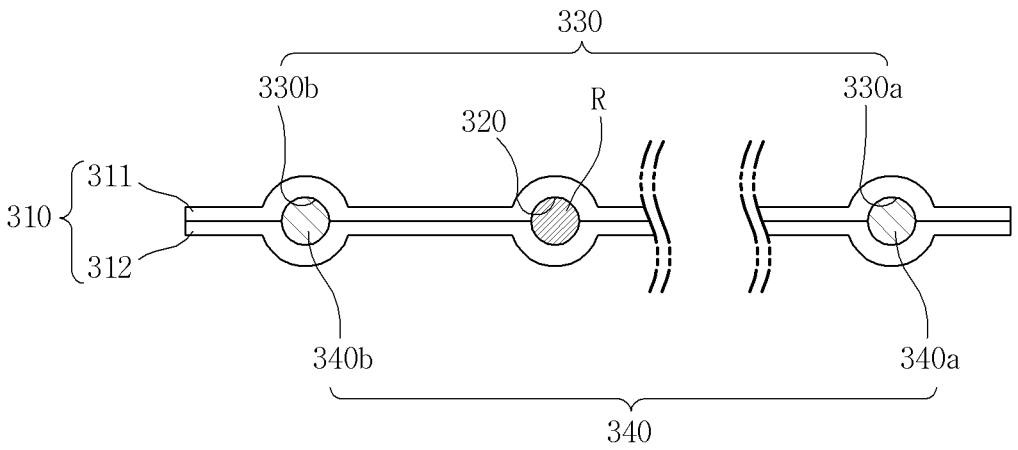
FIG. 11 is a conceptual view illustrating a third embodiment of an evaporator applied to the refrigerator of FIG. 1.
Figure 12:
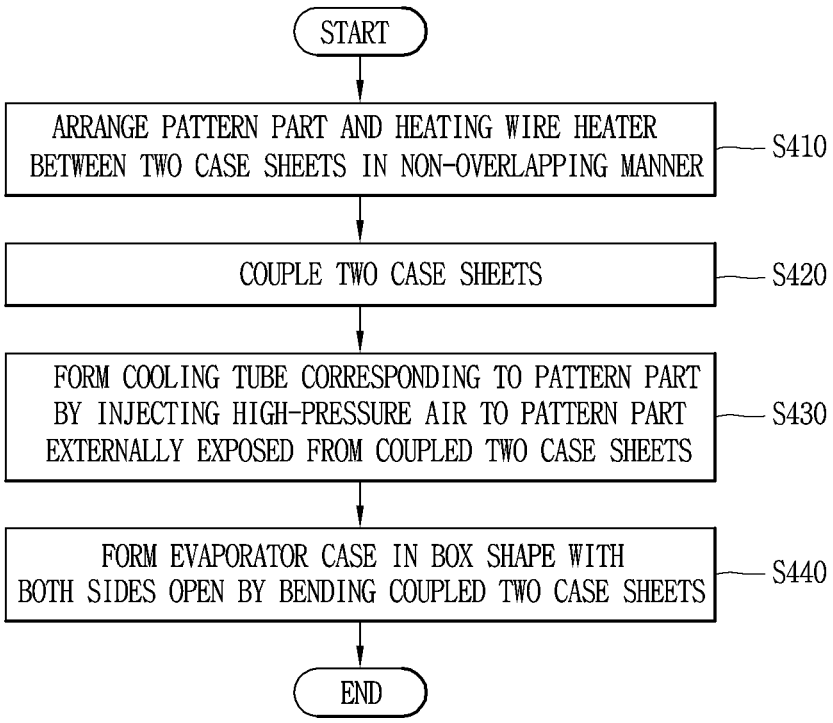
FIG. 12 is a flowchart illustrating a method of fabricating the evaporator of the third embodiment.

FIG. 11 is a conceptual view illustrating a third embodiment of an evaporator applied to the refrigerator of FIG. 1, and FIG. 12 is a flowchart illustrating a method of fabricating the evaporator of the third embodiment.

An evaporator 300 according to this embodiment is configured such that a heating tube 330 is closely adhered on an outer circumferential surface of the heating wire heater 340. That is, an inner circumference of the heating tube 330 is configured to correspond to a diameter of the heating wire heater 340.

As such, unlike the evaporators 100 and 200 according to the first and second embodiments that the remaining inner space, except for the heating wire heater 140, 240, within the heating tube 130, 230 is left as the empty space 131 or filled with the filling agent 260 for the heat transfer, this embodiment does not form the inner space.

With the structure, since first and second case sheets 311 and 312 constructing a heater case 310 are brought into contact with a heating wire heater 340, heat generated in the heating wire heater 340 can be transferred directly to the heater case 310. Therefore, an amount of heat transfer of the heating wire heater 340 can increase (thermal loss reduction) and defrosting efficiency can be improved.

In addition, the structure is not a structure that the heating wire heater 340 is inserted into the heating tube 330 but a structure that the heating tube 330 surrounds the heating wire heater 340. Therefore, the fabricating method of the evaporator 300 is different from those of the evaporators 100 and 200 of the first and second embodiments.

In detail, a pattern part and the heating wire heater 340 are arranged between first and second case sheets 311 and 312 in a non-overlapping manner (S410). An arranged portion of the pattern part is a portion where the cooling tube 320 is formed later, and an arranged portion of the heating wire heater 340 is covered by the heating tube 330 later.

Next, the first and second case sheets 311 and 312 are joined to each other (S420). As one example, after the first and second case sheets 311 and 312 are brought into surface-contact with each other with interposing the pattern part and the heating wire heater 340 therebetween, the first and second case sheets 311 and 312 are pressed into an integrated form using a roller device (thermal press joining).

Accordingly, a frame in a plate shape with the first and second case sheets 311 and 312 in the integrated form is formed, and the pattern part and the heating wire heater 340 are located in the frame.

In this state, high-pressure air is injected to the pattern part externally exposed from the joined first and second case sheets 311 and 312, to form the cooling tube 320 corresponding to the pattern part (S430).

Here, a portion corresponding to the heating wire heater 340 of the first and second case sheets 311 and 312 is deformed to correspond to an outer shape of the heating wire heater 340. As one example, as illustrated, the first case sheet 311 surrounds a part of the heating wire heater 340, and the second case sheet 312 surrounds another part of the heating wire heater 340. Accordingly, the heating tube 330 surrounding the heating wire heater 340 can be entirely formed. The heating tube 330 is brought into contact directly with the heating wire heater 340. That is, an inner circumferential surface of the heating tube 330 comes in contact with an outer circumferential surface of the heating wire heater 340.

Next, the frame in the plate shape with the heating wire heater 340 inserted in the heating tube 330 is bent, to fabricate the evaporator case 310 in an empty box shape with both sides open (S440). As the frame is bent, the heating wire heater 340 inserted in the heating tube 330 can surround the evaporator case 310.

Afterwards, the cooling tube 320 formed in the evaporator case 310 is connected to the cooling pipe 30, such that the refrigerant R circulates along the cooling tube 320. By virtue of the connection, the evaporator 300 is connected to the condenser and the compressor so as to construct a refrigerating cycle.

According to the fabricating method, the evaporator case 310 having the heating wire heater 340 therein can be fabricated merely through a simple process of arranging the heating wire heater 340 between the first and second case sheets 311 and 312 before joining the first and second case sheets 311 and 312 to each other, instead of the processes of arranging the pattern part for forming the heating tube 330 and injecting the high-pressure air. However, to this end, the heating wire heater 340 should endure high-temperature heat generated when joining the first and second case sheets 311 and 312 to each other. As one example, a coated portion of the heating wire heater 340 may be made of a material having heat-resistance at temperature upon the hot-press joining of the first and second case sheets 311 and 312.

In addition, the first and second embodiments have the structure that the heating wire heater 340 is inserted in the heating tube 330, and thus the heating tube 330 should have a linear shape for facilitating the insertion of the heating wire heater 340. However, in this embodiment, since the heating wire heater 340 is arranged before joining the first and second case sheets 311 and 312 to each other, the heating wire heater 340 can have a shape bent at at least one part thereof. Therefore, the heating wire heater 340 does not have to externally extend from both ends of the first and second case sheets 311 and 312, which may result in an increase in design freedom of the heating wire heater 340.

The invention claimed is:

1. An evaporator, comprising:

an evaporator case having a box shape with both sides open, the evaporator case comprising two case sheets that are joined to each other and that are bent to define the box shape;

a cooling tube that corresponds to an empty space between the joined two case sheets and that defines a cooling passage for a flow of refrigerant;

a heating tube that corresponds to an empty space between the joined two case sheets in a non-overlapping manner with the cooling tube; and a heating wire heater that is inserted into the heating tube, that surrounds the evaporator case, and that is configured to, in response to power supplied, generate heat for defrosting the evaporator case, wherein the cooling tube and the heating tube convexly protrude from both surfaces of the joined two case sheets, respectively, wherein the heating tube comprises:

a first heating passage that is disposed at a first side of the cooling tube and that faces one of the open both sides of the evaporator, the first heating passage having a linear shape that extends in one direction along the evaporator case, and a second heating passage that is spaced apart from the first heating passage, that is disposed at a second side of the cooling tube, and that faces the other of the open both sides of the evaporator, the second heating passage having the linear shape that extends in the one direction along the evaporator case.

2. The evaporator of claim 1, wherein the evaporator case comprises a lower surface portion, a left side surface portion and a right side surface portion extending from the lower surface portion to both sides, respectively, and a left upper surface portion and a right upper surface portion extending from the left side surface portion and the right side surface portion to face the lower surface portion, and wherein each of the first and second heating passages comprises opened end portions that are arranged to face each other at an upper portion of the evaporator case.

3. The evaporator of claim 1, wherein the heating wire heater comprises:

a first part inserted into the first heating passage;

a second part inserted into the second heating passage; and a connection part connecting the first part and the second part to each other at an outer side of the evaporator case.

4. The evaporator of claim 3, wherein the first part surrounds a front portion of the evaporator case, and wherein the second part surrounds a rear portion of the evaporator case.

5. The evaporator of claim 3, further comprising a heat-resistant tube surrounding the connection part and formed of a heat-resistant material.

6. The evaporator of claim 1, wherein a remaining inner space, except for the heating wire heater, within each of the first and second heating passages is filled with a filling agent for heat transfer.

7. The evaporator of claim 6, wherein packing members for preventing a leakage of the filling agent are mounted to both ends of each of the first and second heating passages.

8. The evaporator of claim 1, wherein the heating wire heater comprises:

a core part made of an insulating material;

a heating wire part wound around the core part and generating heat in response to power supplied; and a coating part made of an insulating material and surrounding the heating wire part.

9. The evaporator of claim 1, wherein the heating tube is closely adhered on an outer circumferential surface of the heating wire heater.

10. The evaporator of claim 9, wherein the heating wire heater comprises at least one part that has a bent shape.

11. The evaporator of claim 1, wherein the joined two case sheets comprise a first case sheet and a second case sheet that face and contact each other, and wherein the cooling tube convexly protrudes from the first case sheet in a first direction away from the second case sheet, and the heating tube convexly protrudes from the second case sheet in a second first direction away from the first case sheet.

12. The evaporator of claim 1, wherein the heating wire heater comprises:

a first part that is inserted into the first heating passage and that extends in the one direction along the evaporator; and a second part that is inserted into the second heating passage and that extends in the one direction along the evaporator.

13. The evaporator of claim 1, wherein an entire portion of the first heating passage extends in the one direction along the evaporator, and wherein an entire portion of the second heating passage extends in the one direction along the evaporator.

14. A method for fabricating an evaporator, the method comprising:

arranging a first pattern part and a second pattern part between two case sheets in a non-overlapping manner, wherein the first pattern part and the second pattern part are made of a graphite material;

joining the two case sheets to each other;

forming a cooling tube corresponding to the first pattern part and a heating tube corresponding to the second pattern part by injecting high-pressure air to the first pattern part and the second pattern part that are externally exposed from the joined two case sheets to thereby discharge the first pattern part and the second pattern part out of the joined two case sheets;

inserting a heating wire heater for defrosting into the heating tube; and forming an evaporator case in a box shape with both sides open in a manner of bending the joined two case sheets, wherein the cooling tube and the heating tube convexly protrude from both surfaces of the joined two case sheets, respectively, and wherein the heating tube comprises:

a first heating passage that is disposed at a first side of the cooling tube and that faces one of the open both sides of the evaporator, the first heating passage having a linear shape that extends in one direction along the evaporator case, and a second heating passage that is spaced apart from the first heating passage, that is disposed at a second side of the cooling tube, and that faces the other of the open both sides of the evaporator, the second heating passage having the linear shape that extends in the one direction along the evaporator case.

15. The method of claim 14, wherein the heating wire heater extends to an outer side of the evaporator case through the first heating passage and then is inserted through the second heating passage.

* * * * *